US011588284B2

(12) United States Patent
Anfang

(10) Patent No.: US 11,588,284 B2
(45) Date of Patent: Feb. 21, 2023

(54) CABLE ARRANGEMENT

(71) Applicant: Rosenberger Hochfrequenztechnik GmbH & Co. KG, Fridolfing (DE)

(72) Inventor: Christian Anfang, Bergen (DE)

(73) Assignee: ROSENBERGER HOCHFREQUENZTECHNIK GMBH & Co. KG, Fridolfing (DE)

( * ) Notice: Subject to any disclaimer, the term of this patent is extended or adjusted under 35 U.S.C. 154(b) by 190 days.

(21) Appl. No.: 17/289,751

(22) PCT Filed: Sep. 11, 2019

(86) PCT No.: PCT/EP2019/074150
§ 371 (c)(1),
(2) Date: Apr. 29, 2021

(87) PCT Pub. No.: WO2020/094275
PCT Pub. Date: May 14, 2020

(65) Prior Publication Data

US 2021/0367385 A1 Nov. 25, 2021

(30) Foreign Application Priority Data

Nov. 6, 2018 (DE) ..... 10 2018 127 578.1

(51) Int. Cl.
*H01R 24/42* (2011.01)
*H01R 4/18* (2006.01)
*H01R 103/00* (2006.01)

(52) U.S. Cl.
CPC ..... *H01R 24/42* (2013.01); *H01R 4/183* (2013.01); *H01R 2103/00* (2013.01)

(58) Field of Classification Search
CPC ..... H01R 9/0518; H01R 24/42; H01R 4/183; H01R 2103/00
USPC ..... 439/585, 99
See application file for complete search history.

(56) References Cited

U.S. PATENT DOCUMENTS 3,103,548 A 9/1963 Concelman
3,539,709 A * 11/1970 Brancaleone ..... H01R 9/0518 439/585
3,810,076 A * 5/1974 Hutter ..... H01R 9/0518 439/585
4,755,152 A * 7/1988 Elliot ..... H01R 13/5216 174/75 C
5,207,596 A * 5/1993 Tran ..... H01R 9/0518 439/585
5,371,821 A 12/1994 Szegda
7,131,868 B2 11/2006 Montena
(Continued)

FOREIGN PATENT DOCUMENTS

DE 10 2011 056 798 A1 6/2013
DE 20 2015 000 751 U1 4/2015
(Continued)

*Primary Examiner* — Gary F Paumen
(74) *Attorney, Agent, or Firm* — David P. Dickerson

(57) ABSTRACT

The present invention relates to a cable arrangement comprising a cable that has an outer conductor, and an outer-conductor contact element that is electrically connected to the outer conductor and has a diameter change. In a region of the diameter change, the cable arrangement also has a filling element, which is electrically conductive. The filling element is configured to reduce an air inclusion in the region of the diameter change.

18 Claims, 2 Drawing Sheets

(56) References Cited

U.S. PATENT DOCUMENTS

| | | | | |
|---|---|---|---|---|
| 8,191,250 | B2 * | 6/2012 | Kawase | H01R 9/0509 174/75 C |
| 2015/0004826 | A1 * | 1/2015 | Starke | H01R 9/0527 29/862 |

FOREIGN PATENT DOCUMENTS

| | | | |
|---|---|---|---|
| EP | 0 518 597 | A2 | 12/1992 |
| EP | 1 291 981 | A1 | 3/2003 |

* cited by examiner

CABLE ARRANGEMENT

FIELD OF THE INVENTION

The present disclosure relates to a cable arrangement.

TECHNICAL BACKGROUND

Cables are connected in a disconnectable connection via connectors, preferably via plug-in connectors, to another cable or to a printed circuit board. Alternatively, the cable may be connected in a non-disconnectable connection, i.e. in a fixed connection, directly to another cable or to a circuit board without use of a connector.

In the case of a disconnectable connection of a high-frequency cable it is necessary to realize, both for the inner conductor and the outer conductor, respectively, a secure connection to the associated inner-conductor contact and outer-conductor contact of the connector. Equivalently, in the case of a non-disconnectable connection to another cable or to a printed circuit board, it is necessary to effect a secure connection to the inner conductor and outer conductor of the other high-frequency cable, or to the inner-conductor and outer-conductor contact on the printed circuit board.

Crimping, or pressing together, has proven effective for outer-conductor connection. For this purpose, the outer conductor is freed from the cable sheath over a certain portion at the end of the cable, and thus stripped. The outer conductor of the high-frequency cable is thus exposed in this portion. The exposed portion of the outer conductor is then connected to an electrically conductive outer-conductor contact element in a crimping process. A mechanically stable connection between the outer conductor of the high-frequency cable and the outer-conductor contact element, and thus a secure electrical contact between the outer conductor and the outer-conductor contact element, is thereby realized by means of such a conductor crimp.

In respect of high-frequency optimized transmission and contacting, the outer-conductor contact element has a coaxiality with the inner conductor that is equivalent to the outer conductor of the high-frequency cable, and is thus preferably shaped like a sleeve. An outer-conductor contact element shaped in this way is therefore also referred to as a crimp barrel.

To improve the pressing together and to prevent damage to the inner conductor during crimping, the exposed outer conductor is wrapped around a support sleeve that has a certain wall thickness. The crimp barrel, which is crimped with the outer conductor in the region of the support sleeve, thus has a larger inner diameter than the inner diameter of the outer conductor in the high-frequency cable. This abrupt change in the distance between, on the other hand, the inner conductor and the outer conductor of the cable, and on the other hand between the inner conductor of the cable and the outer-conductor contact element, disadvantageously results in a more inductive high-frequency signal path, and thus in an undesirable change in the impedance in the signal path. In order to realize, at least approximately, a constant impedance not only within the high-frequency cable, but along the entire longitudinal extent of the outer-conductor contact element, the crimp barrel has a radial constriction. This radial constriction of the crimp barrel is realized in the longitudinal direction of the cable following the conductor crimp, as shown for example in DE 20 2015 000 751 U1. The radial constriction of the crimp barrel is also referred to as a waist crimp. The radial constriction, i.e. the waist crimp, guides the outer-conductor contact to the insulator part of the high-frequency cable and thus in the direction of the inner conductor.

Due to manufacturing tolerances of the individual components and the individual assembly steps, a cavity forms between the crimp barrel and the insulator part of the high-frequency cable, in the region between the axial end of the outer conductor of the high-frequency cable and the radial constriction of the crimp barrel. This cavity, which is only filled with air and which may vary between the individual assembled cables, represents an interference point in the high-frequency signal path. In the region of this cavity, the distance of the outer-conductor contact to the inner conductor is increased compared to the distance of the outer conductor, or the outer-conductor contact, to the inner conductor in the rest of the signal path. This interference point in the impedance profile of the high-frequency signal path adversely affects the transmission behavior of a high-frequency signal, especially in the two- or three-digit gigahertz range.

This is a situation that needs to be improved.

SUMMARY OF THE INVENTION

Against this background, the present disclosure teaches a cable arrangement, comprising a cable and an outer-conductor contact element, that is optimized in its high-frequency transmission behavior.

Inter alia, the present disclosure teaches a cable arrangement comprising

- a cable that has an outer conductor,
- an outer-conductor contact element that is electrically connected to the outer conductor and has a diameter change,
- wherein, in a region of the diameter change, the cable arrangement has an electrically conductive filling element,
- which is configured to reduce an air inclusion in the region of diameter change.

The present disclosure teaches replacing at least some of the air enclosed in the cavity, which is electrically non-conductive, with an electrically conductive filling element. Optimally, the air enclosed in the cavity is completely replaced by the electrically conductive filling element. In this way, on the outer-conductor-side, the region of the diameter change of the outer-conductor contact element, i.e. the region of the radial constriction of the outer-conductor contact element in which, according to the prior art, the air-filled cavity formed, is filled with electrically conductive material up to the insulator part. The inner diameter of the outer conductor in the region of the diameter change of the outer-conductor contact element is thus matched to the inner diameter of the outer conductor in the other regions of the high-frequency cable and of the outer-conductor contact element. A constant impedance profile is thus advantageously achieved over the entire high-frequency signal path within the high-frequency cable and the outer-conductor contact element, thus extending the use of the high-frequency cable, in particular in the transition to a connector, for high-frequency signals up to the two- or three-digit gigahertz range.

The cable may be a high-frequency cable for transmitting a high-frequency signal. A high-frequency signal is, in the broadest sense, a signal in the frequency range between 3 MHz and 30 THz. A high-frequency cable used in accordance with the present disclosure in the automotive sector is intended for applications in the single-digit to three-digit GHz range. The high-frequency cable may be a coaxial cable having an electrical inner conductor, an insulator part coaxially enclosing the electrical inner conductor, an outer conductor coaxially enclosing the insulator part and a cable sheath coaxially enclosing the outer conductor. In addition, the high-frequency cable may also comprise two electrical inner conductors and a common outer conductor for the transmission of a differential high-frequency signal (so-called shielded twisted-pair cable). Finally, the high-frequency cable may also be realized as a shielded star-quad cable having in each case two crossed and shielded pairs of electrical inner conductors. Additionally possible is a high-frequency cable having any technically appropriate number of shielded pairs of electrical inner conductors that are arranged either parallel to or crossed over each other.

The outer conductor of the cable is produced in the form of a metallic wire gender or a metallic foil for low cable weight and ease of fabrication. The electrical inner conductor of the cable may be produced as a core surrounded by an insulator part. Instead of an electrical inner conductor and an insulator part, an insulated core is also possible.

An outer-conductor contact element of a cable arrangement is a contact element that realizes the outer-conductor-side electrical contact between the outer conductor of the high-frequency cable and an outer-conductor contact of a connector, e.g. of a plug-in connector. The outer-conductor contact element of a cable arrangement is non-disconnectably connected to the outer-conductor contact of the connector, or of the plug-in connector, for example by means of a welded connection. Alternatively, the outer-conductor contact element of the cable arrangement and the outer-conductor contact of the connector, or of the plug-in connector, may be realized as a single component. In addition to the electrical contacting on the outer-conductor side, the outer-conductor contact element of the cable arrangement primarily provides electrical shielding in the transition region between the high-frequency cable and the connector, or the plug-in connector. Equivalently, the outer-conductor contact element of the cable arrangement may be electrically connected, in a non-disconnectable connection, to the outer conductor of another cable or to the outer-conductor-side contact terminal on a printed circuit board or on a housing.

The outer-conductor contact element encloses the exposed electrical inner conductor and the exposed insulator part of the cable and may therefore be shaped like a sleeve, in particular in respect of its shielding function. The sleeve-shaped outer-conductor contact element may have a round cross-sectional profile in order to achieve coaxiality with a single electrical inner conductor of a cable. In addition, for the outer-conductor contact element, in particular in the case of a cable having a plurality of electrical inner conductors, other cross-sectional profiles such as, for example, a square, rectangular or elliptical cross-sectional profile are also covered by the present disclosure. The cross-sectional profile used in each case also depends on the crimping method used.

The outer-conductor contact element may be mechanically and electrically connected to the outer conductor of the cable via a crimped or pressed connection. In addition to a crimped connection, a soldered connection is also conceivable.

The diameter change of the outer-conductor contact element can be abrupt, i.e. discontinuous. For production related reasons, however, the diameter change of the outer-conductor contact element may run over a certain axial extent and has a continuous course, i.e. a slanted or S-shaped course.

The electrically conductive filling element used in a cable arrangement as taught by the present disclosure is made of a single electrically conductive material or of a composite material comprises a plurality of electrically conductive individual materials. In addition, the electrically conductive filling element may also be made of a composite material comprising at least one electrically conductive individual material and at least one dielectric individual material. The decisive factor here is that the electrically conductive filling element has sufficient electrical conductivity for high-frequency signals in the stated frequency range.

The electrically conductive filling element in this case may be a self-contained component without inclusions, or a component that has inclusions. The filling element can be formed according to known shapes, for example as an annular shape, or have any complex and filigree shape. Rather, the decisive factor here is that the electrically conductive filling element at least partially replaces the cavity originally filled with air in the cable arrangement with an electrically conductive material of the filling element.

Advantageous designs and further developments are given by the further dependent claims, as well as by the description with reference to the figures of the drawing.

It is understood that the features mentioned above and those to be explained below may be used not only in the respectively specified combination, but also in other combinations or on their own, without departure from the scope of the present disclosure.

In some embodiments, the electrically conductive filling element is arranged adjacently to an axial end of the outer conductor of the cable, within the outer-conductor contact element. Thus, advantageously, in the axial longitudinal direction of the cable, the electrically conductive filling element at least partially fills the region between the axial end of the outer conductor and the diameter change of the outer-conductor contact element, within the outer-conductor contact element. The distance between the axial end of the outer conductor and the diameter change of the outer-conductor contact element, for example the distance between the axial end of the outer conductor and an end (of the optionally S-shaped course) of the diameter change of the outer-conductor contact element that faces toward the connector, or the plug-in connector, may be less than 2 mm, in particular less than 0.5 mm.

The axial longitudinal extent of the filling element, when the filling element is in the non-incorporated state, is thus to be designed in such a manner that the filling element, when having been incorporated within the cable arrangement, fills the region between the axial end of the outer conductor and, for example, an end (of the optionally S-shaped course) of the diameter change of the outer-conductor contact element that faces toward the connector, or the plug-in connector, as optimally as possible.

Further, in addition to the outer conductor, the cable has an electrical inner conductor, and has an insulator part that is arranged between the outer conductor and the electrical inner conductor. At the end of the cable at which the cable is connected to a connector, or to a plug-in connector, the electrical inner conductor is exposed from the insulator part, and the insulator part is exposed from the outer conductor.

Since the filling element is arranged adjacently to the axial end of the outer conductor, the filling element is located in the region of the exposed insulator part. In particular, the filling element is arranged in a region between the axial end of the outer conductor and the diameter change of the outer-conductor contact element, between the outer-conductor contact element and the insulator. The filling element may enclose the insulator part of the cable concentrically. The electrically conductive filling element, in particular when having been incorporated within the cable arrangement, may bear against the insulator part. In addition, the electrically conductive filling element may bear against the outer-conductor contact element. The electrically conductive filling element thus advantageously also fills the region between the outer-conductor contact element and the insulator part at least partially, in some embodiments completely, in a direction transverse to the longitudinal extent of the cable.

The diameter change of the outer-conductor contact element may constitute a radial constriction. The radial constriction of the outer-conductor contact element may be configured in such a manner that the outer-conductor contact element lies on the insulator part in the region of the smallest radial constriction. Thus, the region in which a filling element can be arranged is closed by the beginning of the region having the narrowest radial constriction of the outer-conductor contact element.

The cable may have a support sleeve that encloses the electrical inner conductor. The exposed outer conductor of the cable is folded back around the support sleeve. The inner diameter of the support sleeve may be slightly larger than the outer diameter of the outer conductor, such that the support sleeve can easily be applied to the outside of the outer conductor. The support sleeve prevents damage to the electrical inner conductor during the crimping or pressing process. In addition, the support sleeve enables improved pressing together of the outer conductor and outer-conductor contact element.

The outer-conductor contact element, which after the crimping or pressing process is electrically connected to the exposed outer conductor folded back over the support sleeve in the region of the support sleeve, is matched in respect of its inner diameter to the outer diameter of the folded-back outer conductor. The distance between the outer-conductor contact element in the region of the support sleeve, i.e. in the non-constricted diameter region of the outer-conductor contact element, and the insulator part may be less than 1.5 mm, in particular less than 1.0 mm. In addition, the transverse extent of the filling element, when the filling element is in the non-incorporated state, is thus to be configured in such a manner that the filling element, when having been incorporated within the cable arrangement, fills the region between the outer-conductor contact element and the insulator part as optimally as possible.

Since the outer-conductor contact element may be crimped to the outer conductor of the cable in the region of the support sleeve, the outer-conductor contact element may be realized as a crimp barrel, in particular in the region of the support sleeve. The crimp type used may be a B-crimp type, which guarantees good mechanical stability of the crimped connection and is easy to produce. Alternatively, however, other crimp types may also be used. The crimped connection is made by a pressing force applied to the outer-conductor contact element from radially outside. The pressing force is applied, in the region of the support sleeve, over the entire circumference of the crimp barrel, such that the crimp barrel completely encircles the outer conductor folded back around the support sleeve.

In addition to this conductor crimp, a further crimp is effected between the outer-conductor contact element and the cable sheath to ensure a more stable attachment of the outer-conductor contact element to the cable. This further crimp is referred to as a sheath crimp or insulation crimp.

In some embodiments, the electrically conductive filling element is elastic. In particular, the electrically conductive filling element is elastic over its entire extent. In this way, the filling element can be adapted to cavities that, for reasons of production, differ in their shape and size. Typically, the elastic filling element, when having been incorporated within the cable arrangement, is thus smaller than in the non-incorporated state. The elasticity of the filling element also allows the cavity to be filled as completely as possible by the filling element.

In a first variant, the electrically conductive and elastic filling element is made of an electrically conductive elastomer. This may be an elastomer containing electrically conductive particles, for example metallic particles, scattered in a certain density. The size and shape of the individual metallic particles may vary slightly or, optimally, in each case match each other. The size, arrangement and distribution of the individual metallic particles within the elastomer are to be selected so that the electrically conductive and elastic filling element has sufficient electrical conductivity over its entire extent for a high-frequency signal in the stated frequency range.

In a second variant, the electrically conductive and elastic filling element comprises an electrically conductive wire, i.e. a metallic wire, that is braided three-dimensionally. The three-dimensional braiding of the metallic wire may be completely random or in a certain order structure. Typically, when the filling element is in the state of not having been incorporated within the filling element, the three-dimensionally braided metallic wire is compressed in respect of a certain shape and a certain extent. Also, the three-dimensionally braided metallic wire may be integrated in an elastomer within the filling element.

If the cable has only a single electrical inner conductor, the insulator part and the outer conductor are each arranged coaxially with the single electrical inner conductor. A filling element, which is inserted into such a cable arrangement, may thus also be arranged coaxially with the single electrical inner conductor. Such a filling element thus has a rotationally symmetrical shape, for example an annular or hollow cylindrical shape.

Finally, the present disclosure also teaches a connector arrangement comprising a connector, for example a plug-in connector, and a cable arrangement. The outer-conductor contact element of the cable arrangement in this case is connected to the outer-conductor contact of the connector, or of the plug-in connector. Alternatively, the outer-conductor contact element of the cable arrangement and the outer-conductor contact of the connector, or of the plug-in connector, may be realized as a single element. Instead of a plug-in connector, the connector may also be realized as a screwed connector, or by means of another connection technique.

The above designs and developments may, if appropriate, be combined with each other in any manner. Further possible designs, developments and implementations may also include combinations of features, described above or below with respect to the embodiments, that are not explicitly mentioned. In particular, persons skilled in the art may also add individual aspects as improvements or additions to the respective teachings herein.

SUMMARY OF THE DRAWING

The present invention is explained in greater detail in the following on the basis of the exemplary embodiments indicated in the schematic figures of the drawing. There are shown therein.

Figure 1A:
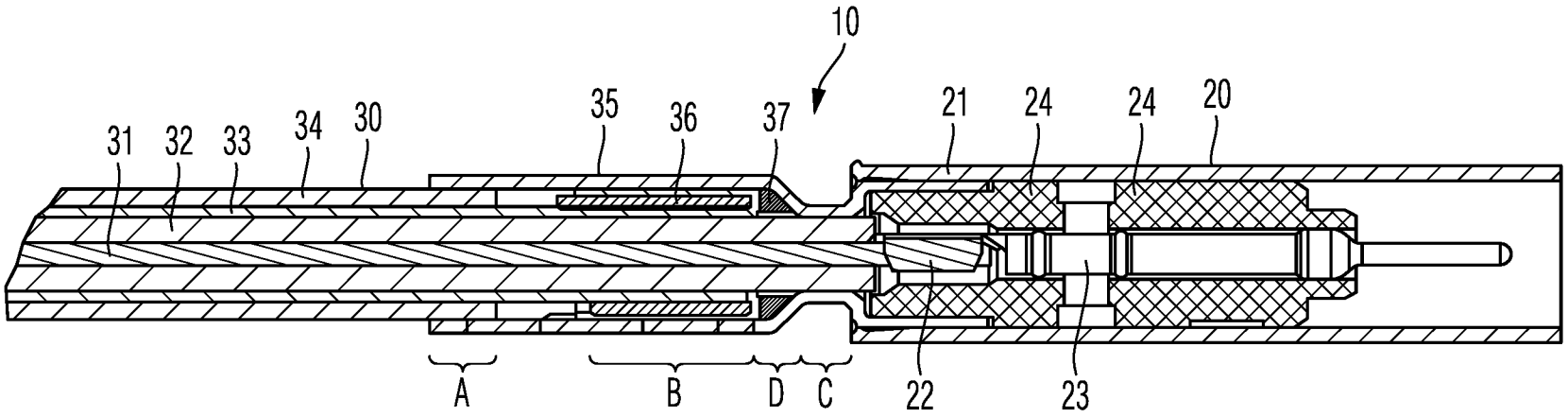
FIG. 1A a cross-sectional representation of a connector arrangement having a plug-in connector realized as a plug connector, FIG. 1B a cross-sectional representation of a connector arrangement having a plug-in connector realized as a coupler, FIG. 2A a top view of a filling element, FIG. 2B a cross-sectional representation of a first variant of the filling element, and FIG. 2C a cross-sectional representation of a second variant of the filling element.

The accompanying figures of the drawing are intended to provide a further understanding of the embodiments of the invention. They illustrate embodiments and serve to explain principles and concepts of the invention in the context of the description. Other embodiments and many of the stated advantages will become apparent from the drawings. The elements of the drawings are not necessarily shown to scale relative to each other.

In the figures of the drawing, elements, features and components that are identical and that have the same function and the same effect are—unless otherwise stated—in each case denoted by the same references.

In the following, the figures are described in a coherent and comprehensive manner.

DESCRIPTION OF THE EXEMPLARY EMBODIMENTS

The connector arrangement 10, represented schematically in FIG. 1A, which is realized as a plug-in connector arrangement, comprises a connector 20 and a cable 30 connected thereto. The connector 20 is realized as a plug-in connector, which in turn is in the form of a plug connector. The connector arrangement represented in FIG. 1A is a coaxial connector arrangement composed of a coaxial plug-in connector and a coaxial cable. Alternatively, non-coaxial connector arrangements, composed of a non-coaxial connector, or plug-in connector, and an associated non-coaxial cable, are also covered by the present disclosure, as already mentioned above.

The cable 30, realized as a coaxial cable, has an electrical inner conductor 31, an insulator element 32 coaxially enclosing the electrical inner conductor 31, an outer conductor 33 coaxially enclosing the insulator element 32 and composed of a wire braid or a conductive foil, and a cable sheath 34 enclosing the outer conductor 33 and composed of an electrically insulating material such as, for example, plastic.

As can be clearly seen from FIG. 1A, the electrical inner conductor 31 of the cable 30 is stripped at its end that faces toward the connector 20, i.e. it is exposed with respect to the insulator part 32. The insulator part 32, at its end that faces toward the connector 20, is also exposed with respect to the outer conductor 33. Finally, the outer conductor 33, at its end that faces toward the connector 20, is also exposed from the cable sheath 34.

The cable end of the cable 30 that faces toward the connector 20 is received in a sleeve-shaped outer-conductor contact element 35. The inner diameter of the outer-conductor contact element 35 corresponds substantially to the outer diameter of the cable sheath 34, such that the cable end of the cable 30 including a certain portion of the cable sheath 34 can be inserted into an opening of the outer-conductor contact element 35, and a subsequent crimping or pressing-together process, between the outer-conductor contact element 35 and the cable 30, is possible.

As already mentioned, the crimping, or pressing-together, process between the cable 30 and the outer-conductor contact element 35 is effected in three different portions of the outer-conductor contact element 35:

In a first portion of the outer-conductor contact element 35, which in FIG. 1A is denoted by A, the outer-conductor contact element 35 is fixed to the cable sheath 34 by means of an insulation crimp. Due to the insulation crimp, the outer diameter of the cable sheath 34 is slightly reduced, or pinched, in the region of the insulation crimp, as can be seen from FIG. 1A.

In a second portion of the outer-conductor contact element 35, which in FIG. 1A is identified by B, the exposed shielding braid of the outer conductor 33 is folded back around a support sleeve 36. The inner diameter of the support sleeve 36 corresponds substantially to the outer diameter of the outer conductor 33 in the non-pressed state, to allow easy insertion of the cable 23 with its outer conductor 33 into the bore of the support sleeve 36. Following insertion of the outer conductor 33 of the cable 23 into the support sleeve 36, the support sleeve 36 is fixed to the outer conductor 33 of the cable 23 by means of crimping. The outer conductor 33 which, because it is realized as a shielding braid or conductive foil, can be easily folded back around the fixed support sleeve 36, is of such a length that it can be folded back over the entire longitudinal extent of the support sleeve 36. Since the outer conductor lies on the support sleeve 36 radially outside the support sleeve 36, along the entire longitudinal extent of the support sleeve 36, a best possible holding force can be realized between the outer conductor 33 and the outer-conductor contact sleeve 36.

In order that the cable 30, with its outer conductor 33 folded back around the support sleeve 36, can be easily inserted into the opening of the outer-conductor contact element 35, the outer diameter of the outer conductor 33 folded back around the support sleeve 36 corresponds substantially to the inner diameter of the outer-conductor contact element 35. The support sleeve 36, which is surrounded both radially inside and radially outside by the outer conductor 33, enables the outer-conductor contact element 35 to be fixed in a more stable manner to the outer conductor 33 of the cable 30 during the crimping, or pressing-together, process. The support sleeve 36 additionally prevents damage to the electrical inner conductor 31 in the case of such a conductor crimp. In particular, owing to the conductor crimp, the portion of the outer conductor 33 located radially inside the support sleeve 36 has a slightly reduced, or pinched, outer diameter in the region of the support sleeve 36, as can be seen from FIG. 1A.

In a third portion of the outer-conductor contact element 35, which in FIG. 1A is identified by C and is located between the axial end of the outer conductor 33 and an end of the outer-conductor contact element 35 that faces toward the connector 20, there is a so-called waist crimp. In the case of this waist crimp, the outer-conductor contact element 35 has a radial constriction. In the region of its narrowest radial constriction, the outer-conductor contact element 35 lies on the exposed insulator part 32 of the cable 30.

Since there is no outer conductor 33 of the cable 30 present in the portion of the high-frequency signal path between the axial end of the outer conductor 33 and the connector 20, the outer-conductor-side high-frequency signal path is formed by the outer-conductor contact element 35. Without the realization of a radial constriction of the outer-conductor contact element 35, the distance between the outer-conductor-side and the inner-conductor-side signal routing, and thus the impedance in this portion, would change compared to the portions of the high-frequency signal path in which, respectively, an outer conductor 33 of the cable 30 is still present. This mismatch of the impedance disadvantageously causes reflections of higher-frequency signal components and impairs the transmission characteristic of the high-frequency signal path. Owing to the radial constriction of the outer-conductor contact element 35, the inner diameter of the outer-conductor contact element 35 in the region of the narrowest radial constriction is reduced to the inner diameter of the outer conductor 33 of the cable 30. In this way, the impedance of the high-frequency signal path in the region of the narrowest radial constriction of the outer-conductor contact element 35 is again matched to the impedance of the high-frequency signal path within the cable 30 and in the region of the outer-conductor contact element 35 up to the axial end of the outer conductor 33.

As can also be seen from FIG. 1A, the outer-conductor contact element 35 has a portion, identified by D in FIG. 1A, in which, on the one hand, there is no outer conductor 33 of the cable 30 and, on the other hand, the distance between the outer-conductor contact element 35 and the electrical inner conductor 33 does not correspond to the adjusted distance between the outer-conductor-side and the inner-conductor-side signal routing. On the one hand, this is due to the fact that the diameter change of the outer-conductor contact element 35 is not effected abruptly, i.e. discontinuously, but in a steady transition over a certain axial longitudinal extent. On the other hand, this portion D results from manufacturing tolerances of the individual components, for example of the outer conductor 33, the support sleeve 36, the outer-conductor contact element 35, the connector 20 etc., and of the individual assembly steps, for example of the conductor crimp and the waist crimp.

The distance between the axial end of the outer conductor 33 and the beginning of the narrowest radial constriction, in which the outer-conductor contact element 35 lies on the insulator part 33, is typically less than 2 mm, for example less than 0.5 mm. According to the prior art, a cavity, filled only with air, is formed in this region of the high-frequency signal path between the axial end of the outer conductor 33, the outer-conductor contact element 35 and the insulator part 33. Within this region, the high-frequency signal path exhibits a discontinuity in its impedance profile, which impairs the transmission characteristic, in particular for higher-frequency signal components in the two- or three-digit gigahertz range.

To overcome this technical disadvantage, an electrically conductive and elastic filling element 37 is arranged in this region, which is adjacent to the axial end of the outer conductor 33. Due to the elasticity of the filling element 37, the cavity formed between the axial end of the outer conductor 33, the outer-conductor contact element 35 and the insulator part 33 can be filled as much as possible with the filling element 37. In this way, it is also possible for the electrically conductive filling element 37 to fill the region up to the insulator part 33, and thus a substantially constant outer-conductor-side inner diameter is realized from the outer conductor 33 of the cable 30 in portion B, via the electrically conductive and elastic filling element 37 in portion D, up to the narrowest radial constriction of the outer-conductor contact element 35 in portion C. The high-frequency signal path thus has substantially no discontinuities in its impedance profile in these portions, and enables optimized transmission behavior for high-frequency signals up to the two- and three-digit gigahertz range.

Figure 2C:
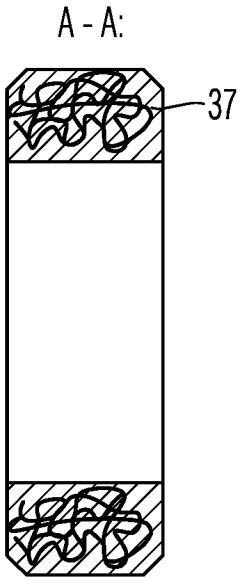
Figure 2B:
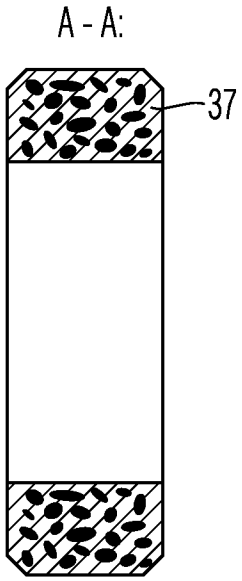
Figure 2A:
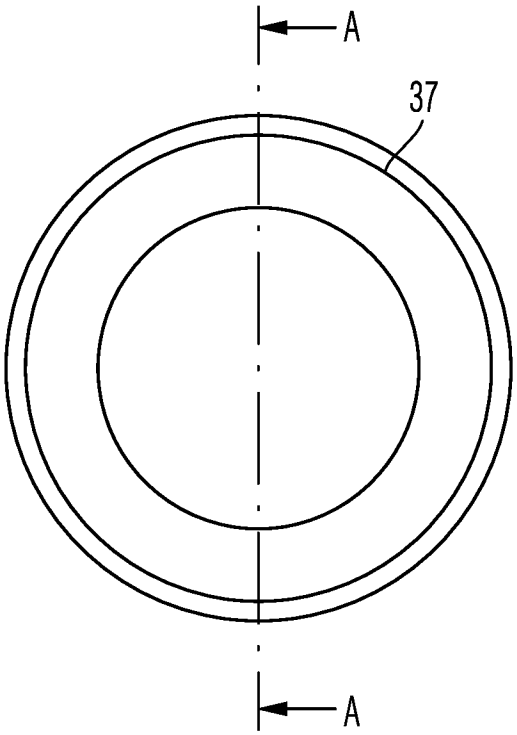

The electrically conductive and elastic filling element 37 encloses the insulator element 33 and thus has a rotationally symmetrical shape, for example an annular or sleeve-shaped shape, as shown in FIG. 2A.

In a first variant, the electrically conductive and elastic filling element 37 according to FIG. 2B is made of an elastomer having integrated electrically conductive particles, for example metallic particles. The number, size, shape and arrangement of the individual electrically conductive particles within the filling element 37 made of elastomer is to be selected so that the electrically conductive and elastic filling element has sufficient electrical conductivity for high-frequency signals up to the two- or three-digit gigahertz range.

In a second variant, the electrically conductive and elastic filling element 37 according to FIG. 2C is made of an elastomer having an integrated electrically conductive wire that is braided three-dimensionally. The three-dimensional braiding of the electrically conductive wire may be completely random or in a specific order structure. For the second variant, also, the length, diameter, type of braiding and density of the electrically conductive and three-dimensionally braided wire is to be selected so that the electrically conductive and elastic filling element has sufficient electrical conductivity for high-frequency signals up to the two- or three-digit gigahertz range.

According to FIG. 1A, the outer-conductor contact element 35 is connected to the outer-conductor contact 21 at its end facing the connector 20, at which it has the same diameter as at its end facing the cable 30, for example by means of a welded joint. This welded connection between the outer-conductor contact element 35 and the outer-conductor contact 21 of the connector 20 in the form of a plug-in connector may, as shown in FIG. 1A, be realized radially inside the outer-conductor contact 21, but also radially outside the outer-conductor contact 21 of the connector 20. As an alternative to the two-part solution composed of an outer-conductor contact element 35 and an outer-conductor contact 21 of the connector 20, a one-part solution is also conceivable, in which the outer-conductor contact element 35 and the outer-conductor contact 21 of the connector 20 together form a single component.

At the cable-side end of the connector 20, realized as a plug-in connector, the electrical inner conductor 31 of the cable 30 is connected to the inner-conductor contact 23 of the connector 20, via a crimped connection 22, in an electrically and mechanically stable manner. Instead of a crimped connection between the electrical inner conductor 31 of the cable 30 and the inner-conductor contact 23 of the connector 20, a soldered connection is also conceivable. The inner-conductor contact 23 is arranged coaxially with the outer-conductor contact 21 within the connector 20 via at least one insulator part 24.

In the variant represented in FIG. 1A, the connector 20 in the form of a plug-in connector is realized as a plug connector. The inner-conductor contact 23 is thus shaped like a pin at the interface-side end of the plug-in connector, within the socket-shaped outer-conductor contact 21.

Figure 1B:
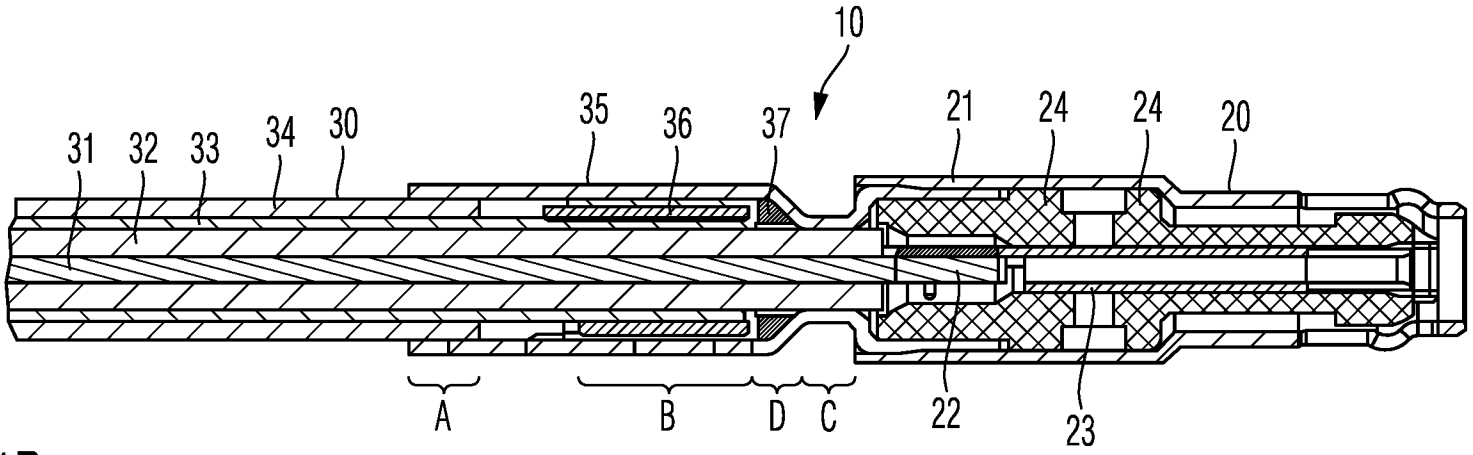

In the variant of a connector arrangement 10 shown in FIG. 1B, the connector 20 in the form of a plug-in connector is realized as a coupler. At the interface-side end of the connector 20, the inner-conductor contact 23 of the connector 23 is thus in the form of a socket. The socket-shaped outer-conductor contact 21 of the connector 20 in the form of a coupler is realized as a spring cage, or spring sleeve, in order to realize on the interface side an elasticity that forms the necessary elasticity for a plug-in operation using a connector 20 in the form of a plug connector.

The other elements of the variant of a connector arrangement 10 shown in FIG. 1B correspond to those of the variant of a connector arrangement represented and already described in FIG. 1A. Description of these elements is therefore not repeated here, and reference is made to the pertinent description of FIG. 1A.

It should be mentioned again at this point that the cable 30, with the outer-conductor contact element 35 attached to it, forms a cable arrangement. The outer-conductor contact element 35 does not necessarily have to be connected to a connector 20 in a connector arrangement 10. Alternatively, the outer-conductor contact element 35, at its end that faces away from the cable 30, may be fixedly connected to another cable, for example a high-frequency cable, in a non-disconnectable connection. Finally, a non-disconnectable connection, for example a soldered connection, of the outer-conductor contact element 35 to an outer-conductor-side contact terminal, or ground connection, on a printed circuit board or in a housing is also possible. In this case, the electrical inner conductor 31 of the cable 30 may be connected, via a soldered connection, to an inner-conductor-side contact terminal on a printed circuit board, or in a housing.

Although the present invention has been fully described above on the basis of various embodiments, it is not limited thereto, but may be modified in a variety of ways.

LIST OF REFERENCE NUMERALS

10 connector arrangement
20 connector
21 outer-conductor contact
22 crimped connection
23 inner-conductor contact
24 insulator part
30 cable
31 electrical inner conductor
32 insulator part
33 outer conductor
34 cable sheath
35 outer-conductor contact element
36 support sleeve
37 filling element

The invention claimed is:

1. A cable arrangement, comprising:
a coaxial cable;
a first conductive sleeve;
a second sleeve; and
an electrically conductive, elastic element, wherein
said first conductive sleeve comprises a first portion, a second portion and a transition portion intermediate said first portion and said second portion,
said first portion has a first diameter,
said second portion has a second diameter smaller than said first diameter,
a first end of said second sleeve is situated inside said first portion,
an outer conductor of said coaxial cable extends through said second sleeve and folds back at said first end,
a folded back portion of said outer conductor is situated between said first conductive sleeve and said second sleeve, and
said electrically conductive, elastic element is situated between said first end and an interior surface of said transition portion.

2. The cable arrangement of claim 1, wherein:
said transition portion has said first diameter at a junction with said first portion and has said second diameter at a junction with said second portion.

3. The cable arrangement of claim 1, wherein:
said electrically conductive, elastic element and said outer conductor collectively fill substantially an entirety of a space bounded, in an axial direction, by said first end and said interior surface and bounded, in a radial direction, by an insulator of said coaxial cable and said first conductive sleeve.

4. The cable arrangement of claim 1, wherein:
said coaxial cable comprises an insulator between an inner conductor of said coaxial cable and said outer conductor.

5. The cable arrangement of claim 4, wherein:
an outer diameter of said insulator is substantially identical to said second diameter.

6. The cable arrangement of claim 5, wherein:
an inner diameter of said electrically conductive, elastic element is substantially identical to said second diameter.

7. The cable arrangement of claim 1, wherein:
an interior circumference of said second portion abuts an outer circumference of an insulator of said coaxial cable.

8. The cable arrangement of claim 1, wherein:
said folded back portion of said outer conductor is sandwiched between an interior circumference of said first portion and an outer circumference of said second sleeve.

9. The cable arrangement of claim 1, wherein:
said electrically conductive, elastic element has a generally annular shape.

10. A cable arrangement, comprising:
an insulator;
an inner conductor;
an outer conductor;
a first conductive sleeve; and
an electrically conductive, elastic element, wherein
said inner conductor extends through said insulator,
in a first region of said cable arrangement, an inner circumference of said outer conductor abuts a first portion of an outer circumference of said insulator,
in a second region of said cable arrangement adjacent said first region, an inner circumference of said electrically conductive, elastic element is substantially adjacent a second portion of said outer circumference of said insulator, and
in a third region of said cable arrangement adjacent said second region, an inner circumference of said first conductive sleeve abuts a third portion of said outer circumference of said insulator.

11. The cable arrangement of claim 10, wherein:
said electrically conductive, elastic element is situated inside said first conductive sleeve.

12. The cable arrangement of claim 10, wherein:
said inner conductor, said insulator and said outer conductor constitute a coaxial cable, and
a portion of said coaxial cable is situated inside said first conductive sleeve.

13. The cable arrangement of claim 10, comprising:
a second sleeve, wherein
a first end of said second sleeve is situated inside said first region,
an outer conductor extends through said second sleeve and folds back at a first end of said second sleeve.

14. The cable arrangement of claim 13, wherein:

a folded back portion of said outer conductor is situated between said first conductive sleeve and said second sleeve.

15. The cable arrangement of claim 13, wherein:

a folded back portion of said outer conductor is sandwiched between an interior circumference of said first conductive sleeve and an outer circumference of said second sleeve.

16. The cable arrangement of claim 13, wherein:

said second sleeve is situated in said first region.

17. The cable arrangement of claim 10, wherein:

said electrically conductive, elastic element has a generally annular shape.

18. The cable arrangement of claim 10, wherein:

a diameter of said first portion is substantially identical to a diameter of said second portion and to a diameter of said third portion.

* * * * *